US006319016B1

(12) United States Patent
Juntwait

(10) Patent No.: US 6,319,016 B1
(45) Date of Patent: Nov. 20, 2001

(54) RADIO FREQUENCY CONNECTOR TO PRINTED CIRCUIT BOARD ASSEMBLY WITH A BACK COVER

(75) Inventor: Eric Juntwait, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 33 days.

(21) Appl. No.: 09/832,212

(22) Filed: Apr. 9, 2001

Related U.S. Application Data

(63) Continuation-in-part of application No. 09/775,414, filed on Jan. 31, 2001.

(51) Int. Cl.[7] ..... H01R 12/00

(52) U.S. Cl. ..... 439/63; 439/521; 439/579; 439/581

(58) Field of Search ..... 439/63, 579, 581, 439/367, 519, 521, 133, 134, 135

(56) References Cited

U.S. PATENT DOCUMENTS 6,036,535 * 3/2000 Whiteman, Jr. et al. ..... 439/519
6,053,744 * 4/2000 Gray et al. ..... 439/63
6,132,244 * 10/2000 Leeman et al. ..... 439/63
6,183,274 * 2/2001 Allum ..... 439/135

* cited by examiner

*Primary Examiner*—Tho D. Ta
(74) *Attorney, Agent, or Firm*—Wei Te Chung

(57) ABSTRACT

A radio frequency connector assembly has s a die cast housing (1), a number of RF coaxial contacts (2), two insert-molded lead frame assemblies (3) and a back cover (4) with a pair of arms (41). The die cast housing includes a pair of side walls (10) each defining a slot (101) therein, a front wall (11) and a rear wall (13), and a plurality of passageways (130, 131). The arms of the back cover are latched in the corresponding slots of the side walls. The back cover has two pairs of inner and outer ribs (44, 47), each outer rib (47) defining a pair of pits (48) thereof for accommodating the inner conductors of the coaxial contacts.

11 Claims, 9 Drawing Sheets

RADIO FREQUENCY CONNECTOR TO PRINTED CIRCUIT BOARD ASSEMBLY WITH A BACK COVER

CROSS-REFERENCE TO RELATED APPLICATION

This application is a continuation-in-part of co-pending U.S. patent application Ser. No. 09/775,414 filed on Jan. 31, 2001, entitled "RADIO FREQUENCY CONNECTOR TO PRINTED CIRCUIT BOARD ASSEMBLY USING AN INSERT-MOLDED LEAD FRAME ASSEMBLY".

FIELD OF THE INVENTION

The present invention relates to a radio frequency (RF) connector assembly for attaching to a printed circuit board (PCB), and particular to an RF connector assembly having a back cover and an insert-molded lead frame assembly firmly mounted at a rear thereof.

BACKGROUND OF THE INVENTION

U.S. Pat. No. 6,053,744 utilizes a two-step moulded interconnect device (MID) molding process where radio frequency (RF) connectors are connected to the PCB with plated plastic. The adapter in this prior patent comprises a plastic body which has a plated body area, a plated through hole and solder tabs connecting the plated body area to be directly connected to traces on a PCB. An electrical contact attains an interference fit with the plated through hole, providing a first electrical signal path communicating between the contact and the plated through hole to the solder tab. An outer shell of the RF connector mates with a connector interface of the adapter, providing a second electrical signal path communicating between the outer shell of the RF connector and solder tabs via the plated body area and the connector interface. The first and second signal paths could then be connected to the PCB by the solder tabs, respectively.

However, this is a very complicated and expensive product, which will produce large amount of production scrap and long lead time.

Hence, an improved RF connector is needed to overcome the above-mentioned deficiencies of current RF connectors.

SUMMARY OF THE INVENTION

Accordingly, the primary object of the present invention is to provide a Radio Frequency (RF) connector assembly having a back cover to reliably secure contacts.

Another object of the present invention is to provide a RF connector assembly having a back cover which firmly retains a lead frame assembly in position.

An RF connector assembly in accordance with the present invention comprises a die cast housing, a plurality of RF coaxial contacts, two insert-molded lead frame assemblies and a back cover with a pair of arms. The die cast housing includes a pair of side walls each defining a slot therein, a front wall and a rear wall defining a plurality of inner and outer passageways. The lead frame assemblies are made by insert-molding lead contacts into an insulative portion. The lead frame assemblies are installed in the inner and outer passageways of the die cast housing. The arms of the back cover are latched in the corresponding slots of the side walls. The back cover has two pairs of inner and outer ribs, each outer rib defining a pair of pits for accommodating the inner conductors of the coaxial contacts.

Other objects, advantages and novel features of the invention will become more apparent from the following detailed description when taken in conjunction with the accompanying drawings.

BRIEF DESCRIPTION OF THE DRAWINGS

FIG. 4 is a plan view of lead contacts the lead frames of FIG. 3 wherein plastic assemblies have not yet been incorporated therein to.

DETAILED DESCRIPTION OF THE INVENTION

Figure 1:
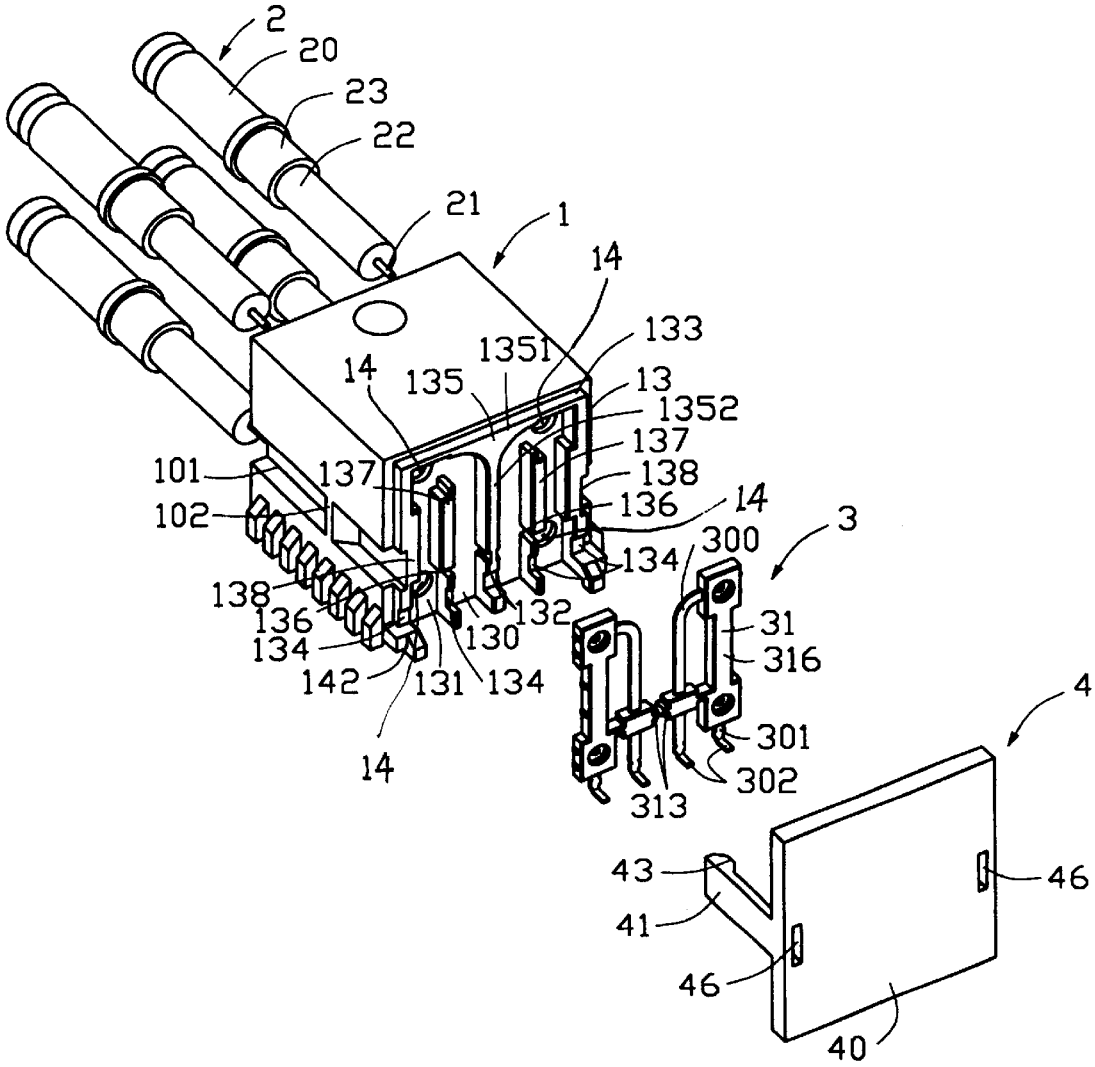
FIG. 1 is an exploded view of a radio frequency (RF) connector assembly in accordance with the present invention.
Figure 2:
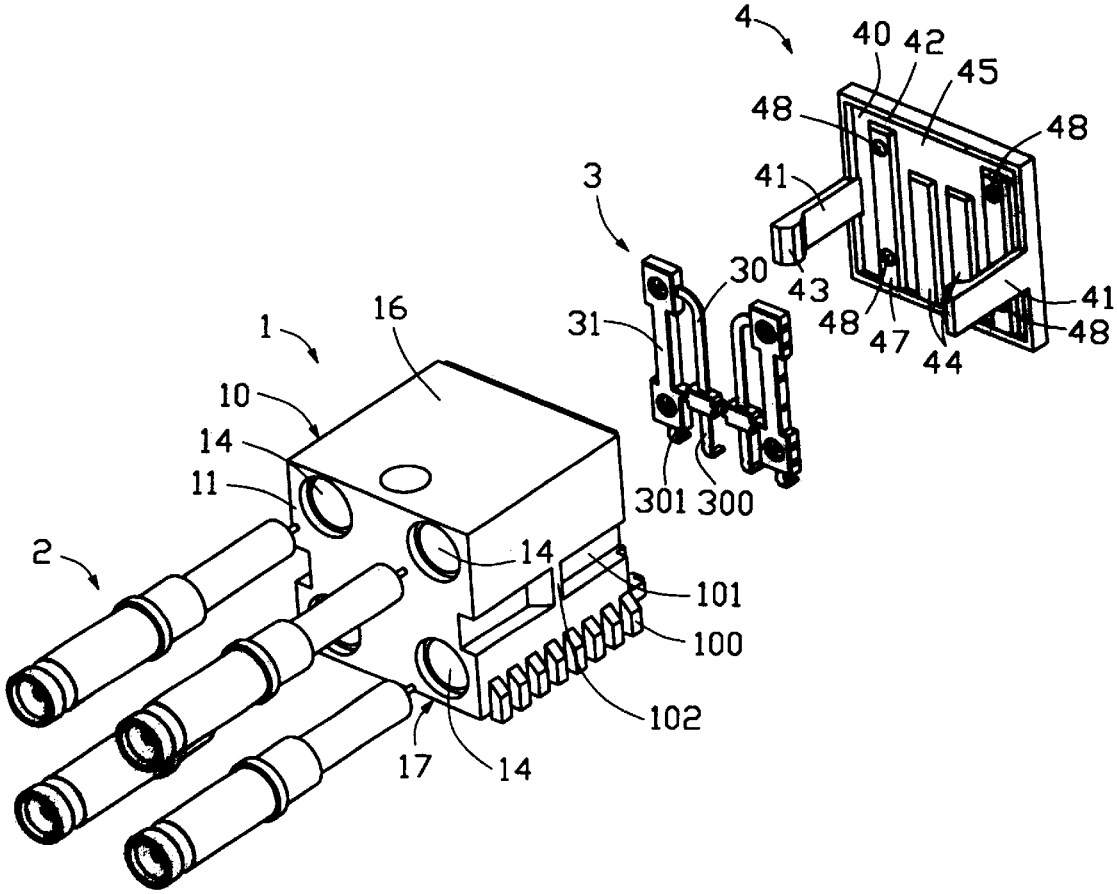
FIG. 2 is a view of the RF connector assembly of FIG. 1 from another aspect.

Reference will now be made in detail to the preferred embodiment of the present invention.

Referring to FIGS. 1–4, a radio frequency (RF) connector assembly in accordance with the present invention comprisesa die cast housing 1, four RF coaxial contacts 2 and two lead frame assemblies 3.

The die cast housing or plated plastic 1 includes a pair of side walls 10, a front wall 11 and a rear wall 13 opposite to each other, an upper surface 16 and a bottom surface 17 opposite to each other. Four stepped, plated through channels 14 extend through the front wall 11 to the rear wall 13.

Each side wall 10 forms a row of grounding tabs 100 at a lower end for soldering to a printed circuit board (PCB) 5. Each side wall 10 defines in approximately a middle section thereof a slot 101 extending through the front wall 11 the rear wall 13. A connecting tab 102 projects from each slot 101 of the housing 1.

The rear wall 13 forms a T-shaped part 135 in a middle section thereof, a pair of side parts 138 at two sides thereof and a pair of middle parts 137 between the T-shaped part 135 and the side parts 138. The middle parts 137 and the side parts 138 are respectively distributed symmetric about the T-shaped part 135. The T-shaped part 135 includes a pair of horizontal cross arms 1351 with two ends in connection with two upper ends of the side parts 138, and a vertical support arm 1352 parallel to the middle parts 137 and the side parts 138. A pair of securing tabs 142 is rearwardly formed on a lower section of the rear wall 13 adjacent the corresponding side part 138.

The rear wall 13 defines a guideway 133 along an outer peripheral edge thereof. Five cutouts 134 are defined respectively in a lower portion of the two middle parts 137, the side parts 138 and the support arm 1352 of the Tshaped part 135. A pair of gaps 136 is defined at a bottom section of the middle parts 137 above the cutouts 134. A pair of cutouts 132 is defined in two side edges of the support arm 1352. A pair of die cast inner passageways 130 is defined adjacent either side of the support arm 1352 of the T-shaped part 135, and a pair of die cast outer passageways 131 is defined parallel to the inner passageways 130 but farther from the support arm 1352. The inner and outer passageways 130, 131 merge at their respective upper ends (not labelled) and communicate with the plated through channels 14 of the die cast housing 1.

Each RF coaxial contact 2 includes an inner conductor 21, an outer conductor 20 surrounding the inner conductor 21 and an insulator 22 insulating the outer conductor 20 from the inner conductor 21. The outer conductor 20 includes a knurled area 23 at a rear most section thereof to improve retention to the housing 1 and reliably fix the RF coaxial contacts 2. The outer conductor 20, the insulator 22 and the inner conductor 21 are successively formed in a longitudinal direction. Since the structure and the function of RF coaxial contacts 2 is well known to those skiled in the art, a detailed description thereof is omitted herein.

Figure 3:
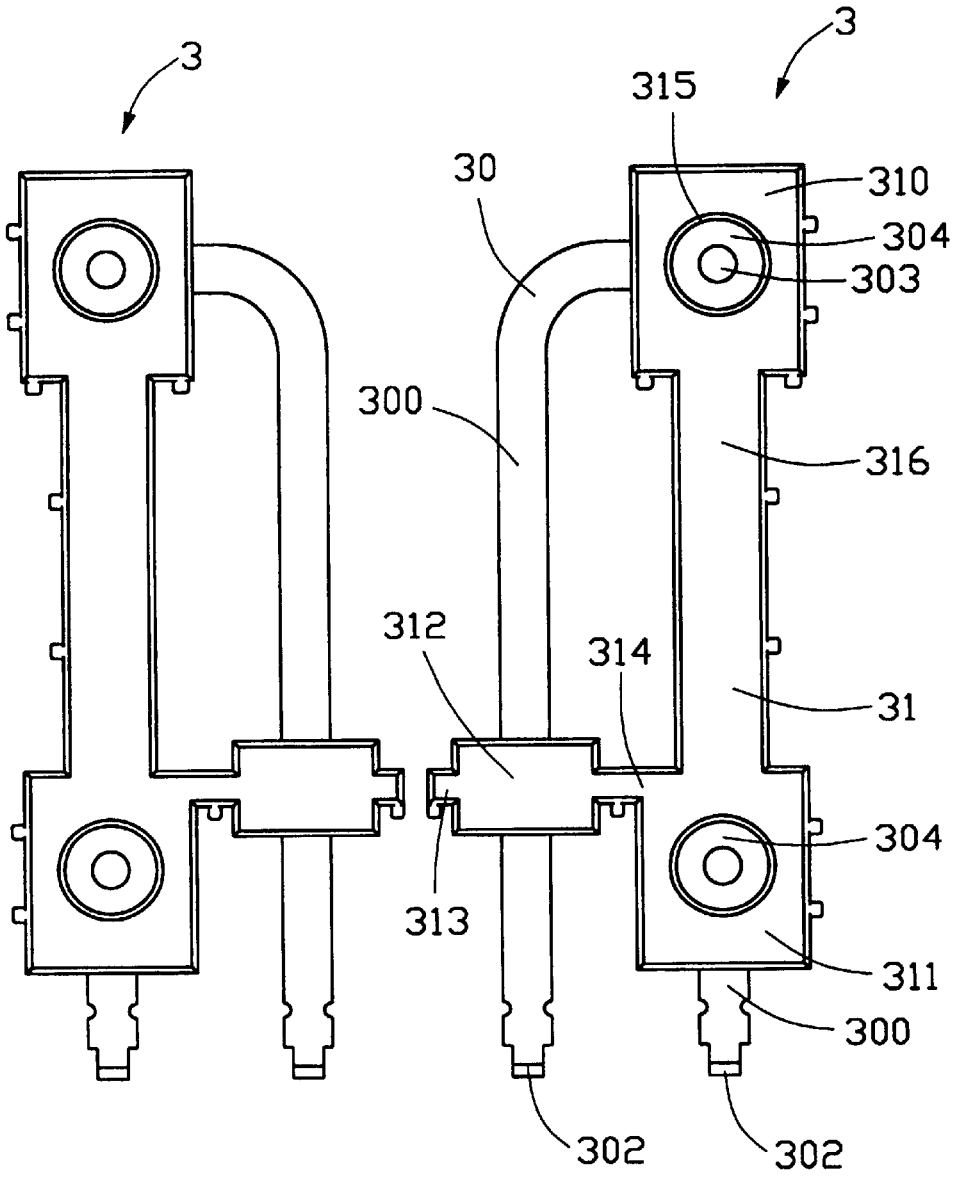
FIG. 3 is a plan view of two lead frame assemblies of the RF connector assembly of FIG. 1.
Figure 4:
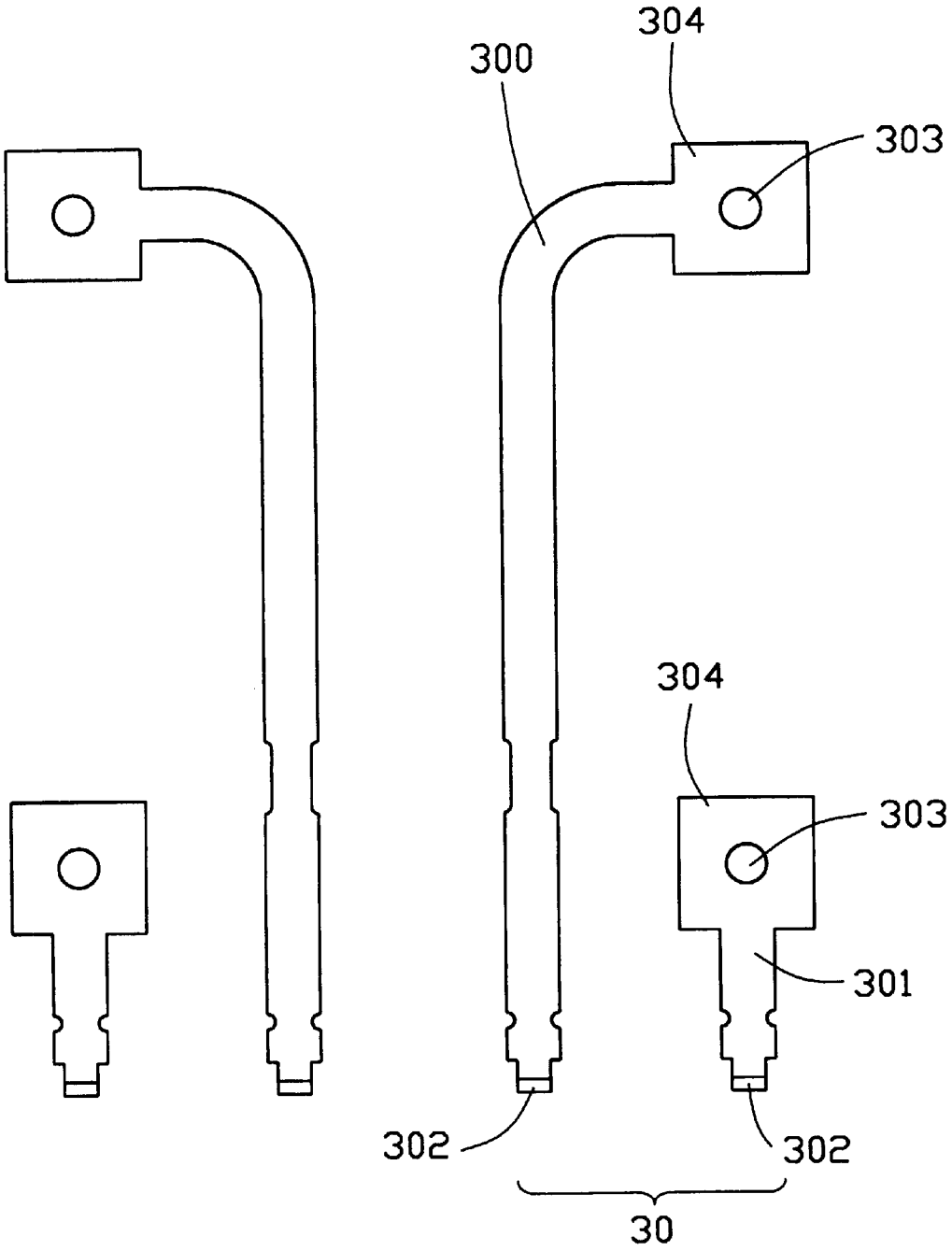

Particularly referring to FIGS. 3 and 4, each lead frame assembly 3 includes a lead frame 30 insert-molded in an insulative portion 31.

Each lead frame 30 comprises a long first lead contact 300 and a short second lead contact 301. The first lead contact 300 forms a right angle bend at an upper section thereof, while the second lead contact 301 is straight. Each of the first and second lead contacts 300, 301 has a square end 304 at a top end thereof and a horizontal contact foot 302 at a lower end. A small hole 303 is defined in a center of each square end 304.

The insulative portions 31 are made of plastic in the present invention and are mirror images of each another. Each insulative portion 31 comprises a rectangular top block 310 and a rectangular bottom block 311, a connecting portion 316 interconnecting the top block 310 with the bottom block 311, a side block 312 and a support portion 314 connecting the bottom block 311 with the side block 312. Each top and bottom blocks 310, 311 defines a large hole 315 through a center thereof and covers the square end 304 of the corresponding lead frame 30 except where the large holes 315 expose opposite faces of the square ends 304 immediately around the small holes 303 of the first and second lead contacts 300, 301. The side block 312 is insert molded around the first lead contact 300 at a lower section of the first lead contact 300. The side block 312 outwardly forms aprotrusion 313 opposite to the support portion 314. The plastic material of the insulative portion 31 is minimized to optimize the impedance and electrical performance of the first and second lead contacts 300, 301, and therefore the entire RF connector assembly.

The back cover 4 includes a plate 40 forming a guideframe 42 around an outer peripheral edge of the back cover 4, a pair of resilient arms 41 forwardly and perpendicularly projecting from two sides of the back cover 4. A cavity 45 is bordered by the guideframe 42. A pair of holes 46 is defined in a rear surface of the back cover 4 beside the corresponding arm 41. Each arm 41 inwardly forms a protrusion 43 on an end thereof. Two pairs of inner and outer ribs 44, 47 are parallelly formed in the cavity 45, each inner rib 44 and each outer rib 47 having a lower end in connection with a lower section of the guideframe 42. Each inner rib 44 and each outer rib 47 have an upper end away from an upper section of the guideframe 42. The inner ribs 44 are adjacent to each other and the outer ribs 47 are symmetrically formed at two sides of the inner ribs 44. The pair of arms 41 extends in the same direction of the pairs of inner and outer ribs 44, 47. Each outer rib 47 defines a pair of pits 48 in an upper and lower section thereof for receiving the inner conductors 21 of the RF coaxial contacts 2. The pits 48 in the outer ribs 47 are slightly distanced from the inner conductors 21 to bring relief for solder joint between the inner conductors 21 and the first and second lead contacts 300, 301 of the lead frame assembly 3.

Figure 5:
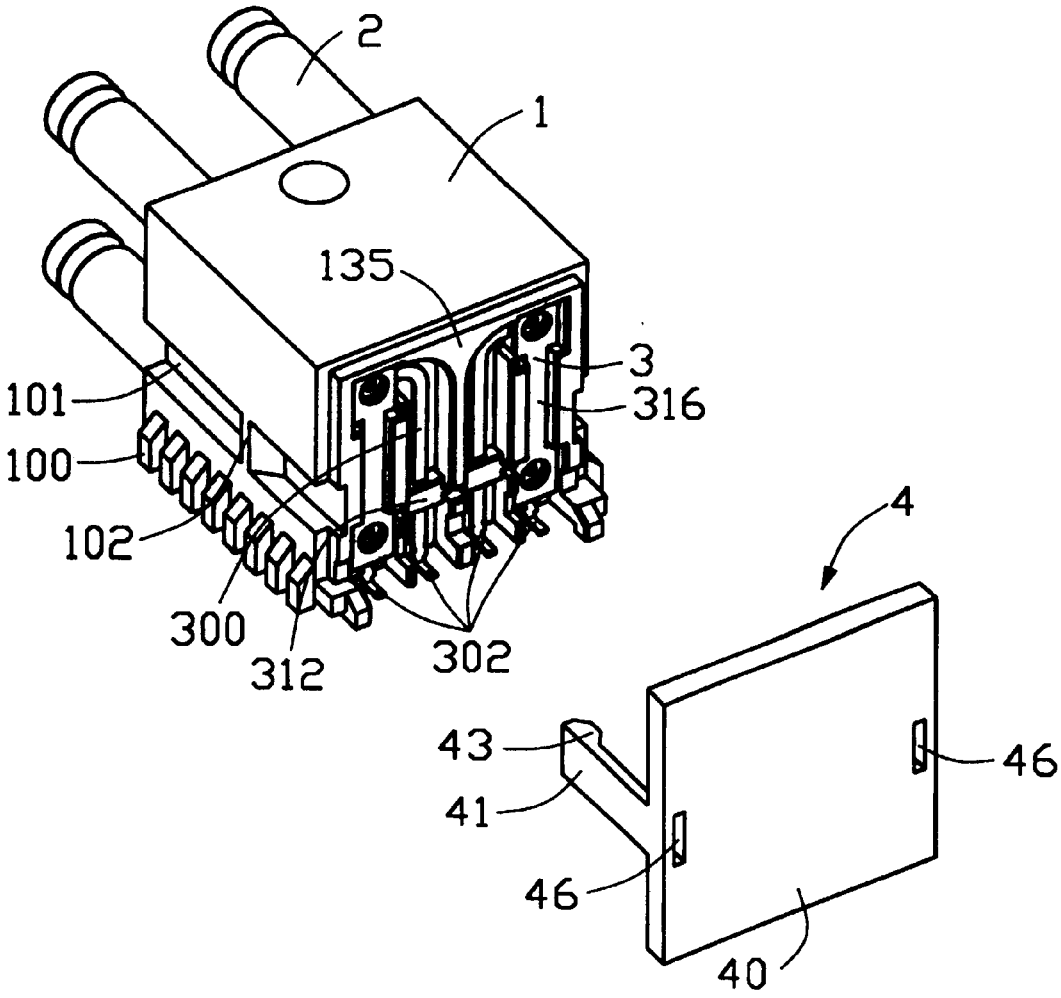
FIG. 5 is an assembled view of FIG. 1, wherein a back cover is removed from the RF connector assembly to show the lead frame assemblies mounted to the RF connector assembly.
Figure 6:
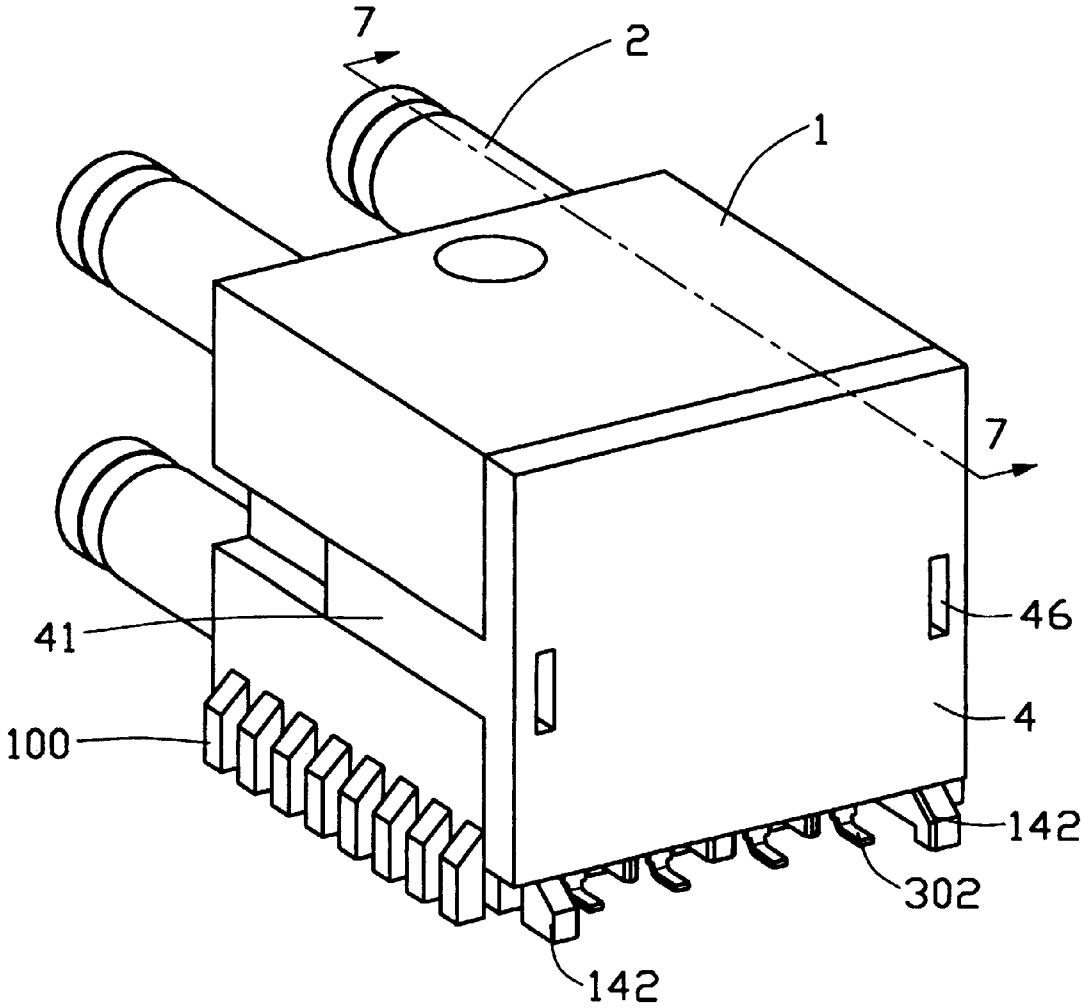
FIG. 6 is a view similar to FIG. 5, wherein the back cover is mounted on the RF connector assembly.
Figure 7:
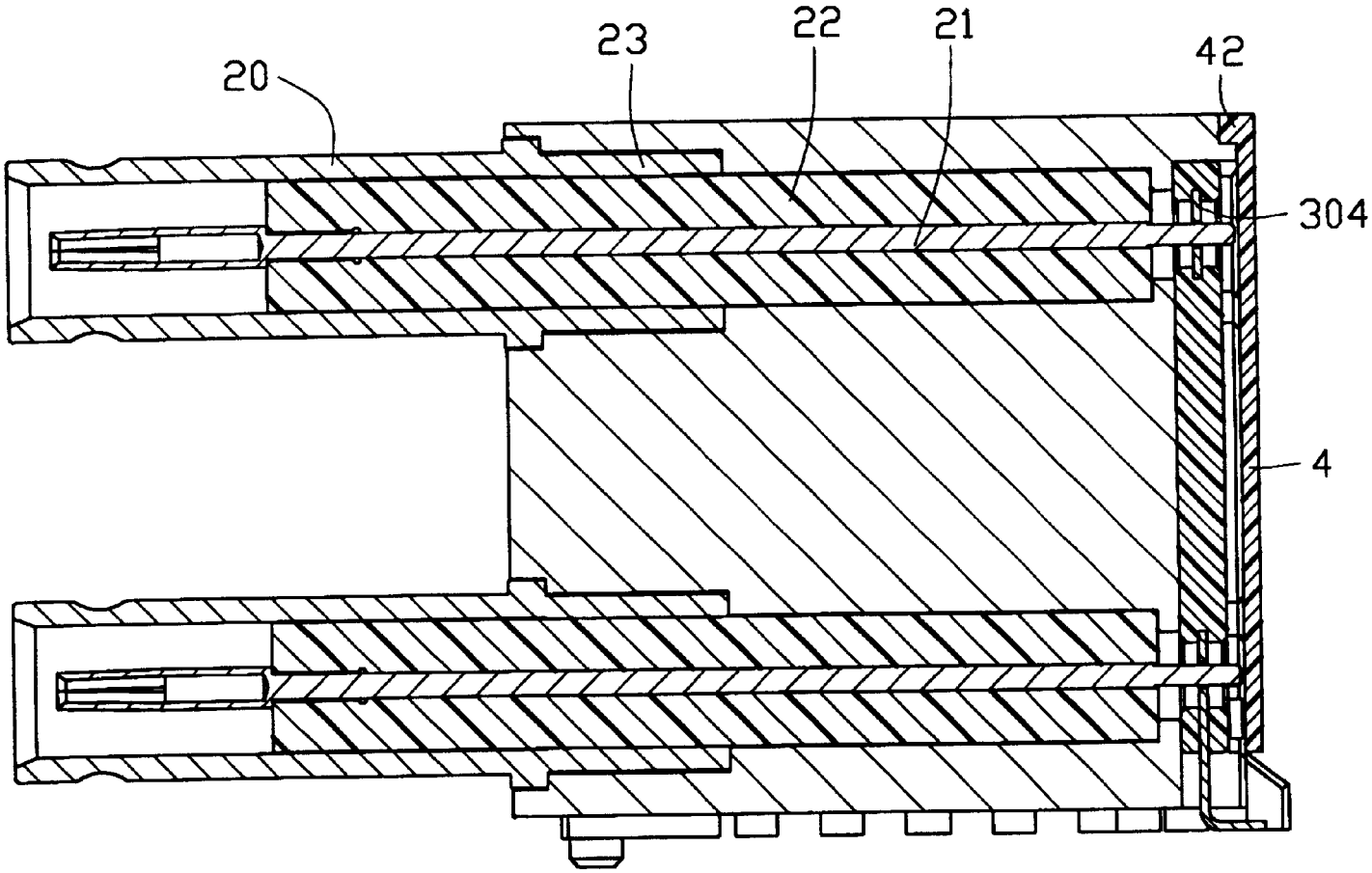
FIG. 7 is a cross-sectional view taken along line 7—7 of FIG. 6.

Referring to FIGS. 5–7, in assembly, the RF coaxial contacts 2 are pressed into the plated through channels 14 of the die cast housing 1 until the insulator 22 and the lengthened knurled area 23 are received in the channels 14. The outer conductor 20 of each RF coaxial contact 2 electrically connects with the corresponding plated through channels 14 for grounding purposes. The inner conductor 21 is exposed from a rear of the through channel 14 into the corresponding outer passageway 131. Thus the die cast housing 1 surrounds the insulator 22 of the RF coaxial contact 2 to provide uniform impedance.

The lead frame assemblies 3 are inserted into the rear wall 13 of the die cast housing 1. The first lead contacts 300 are respectively located in the corresponding inner passageways 130 and the two connecting portions 316 and the second lead contacts 301 are respectively located in the corresponding outer passageways 131 opposite to each other. The large and small holes 315, 303 are aligned with the corresponding plated through channels 14 of the die cast housing 1 and the inner conductor 21 protrudes through the small hole 303 and into a rearward large hole 315 of the lead frame assembly 3. The support portions 314 of the lead frame assemblies 3 are received in the corresponding gaps 136 and the protrusions 313 are received in the corresponding cutouts 132. The inner conductor 21 of each RF coaxial contact 2 is soldered to the square end 304 of a corresponding first or second lead contact 300, 301. The first lead contacts 300 are retained in the inner passageways 130 to maintain impedance control. The lead frame assemblies 3 located within the inner and outer passageways 130, 131 in the die cast housing 1 are optimized for a desired impedance.

The guideframe 42 of the back cover 4 is pressed forward into the guideway 133 and the cutouts 134 of the rear wall 13. The resilient arms 41 are received in the corresponding sbts 101 with the protrusions 43 latched on the corresponding connecting tabs 102. The inner contacts 21 are respectively received in the corresponding pits 48 of the back cover 4. The inner and outer ribs 44, 47 respectively support the corresponding support portions 314 and the corresponding connecting portions 316.

Figure 9:
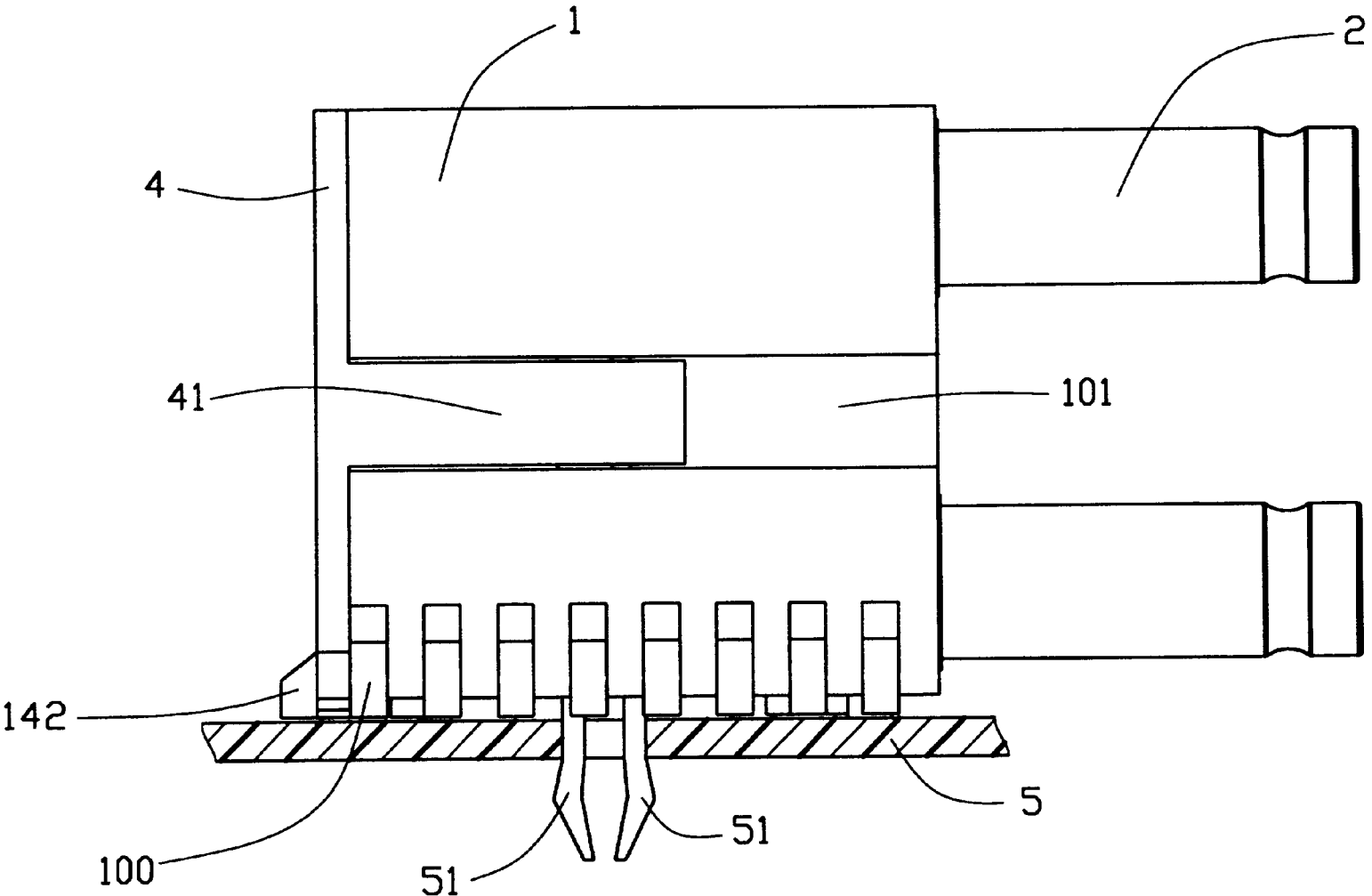
FIG. 9 is a side view of FIG. 8.

A pair of board locks 51 is received in a center of the bottom surface 17 in left-to-right direction for locking the RF connector assembly onto the PCB 5 (see FIG.9). Since the structure and the function of board locks 51 is well known to those skilled in the art, a detailed description thereof is omitted herein.

Figure 8:
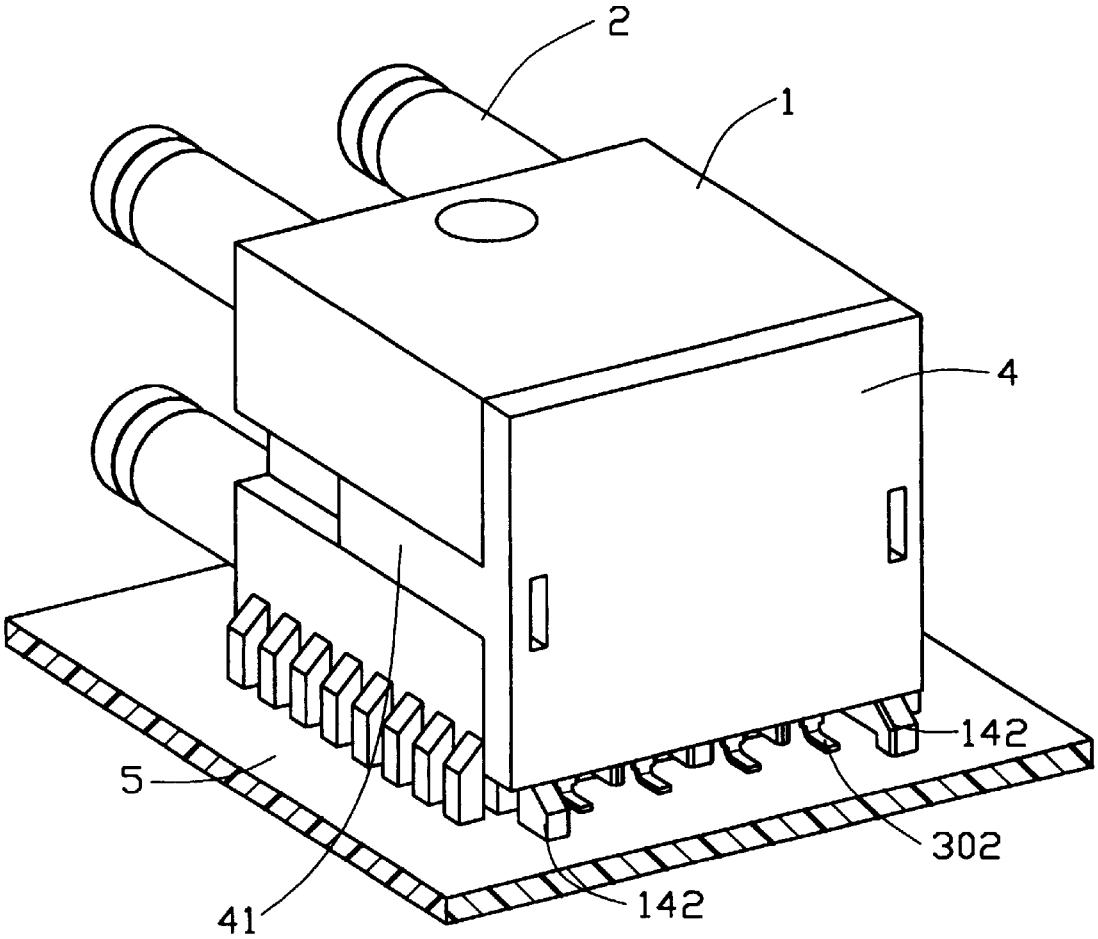
FIG. 8 is an assembled view of the RF connector assembly of the present invention mounted on a printed circuit board.

Referring to FIGS. 8–9, in use, the grounding tabs 100 and the securing tabs 142 of the die cast housing 1 and the contact feet 302 of the lead frame assemblies 3 are all soldered to the PCB 5, so the die cast housing 1 and the inner conductors 21 of the RF coaxial contacts 2 are electrically connected with the PCB 5. The board locks 51 are downwardly inserted into the corresponding holes (not shown and not labeled) of the PCB 5.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical connector for mounting on a printed circuit board, comprising:

a conductive housing having a rear wall, a pair of side walls, and a first and a second through channels extending in a front-to-back direction, each side wall defining a slot therein;

a first and a second coaxial contacts received within said first and second through channels, respectively, each coaxial contact including an inner conductor, an outer conductor enclosing said inner conductor and an insulator insulating the outer conductor from the inner conductor, said outer conductor mechanically and electrically engaging with the housing;

a lead frame assembly being attached to the rear wall of the housing, said lead frame assembly including a first lead contact, a second lead contact and an insulative portion securing the first lead contact and the second lead contact therewith, said first and second lead contacts mechanically and electrically engaged with corresponding inner conductors of said first and second coaxial contacts, respectively; and a back cover including a pair of arms latched in the slots of the housing and a pair of ribs supporting said insulative portion of the lead frame assembly in the rear wall of the housing.

2. The connector in accordance with claim 1, wherein each arm of the back cover has a protrusion at an inner side thereof, and wherein a connecting tab projects from said slot of the housing for latching the protrusion of the back cover.

3. The connector in accordance with claim 1, wherein said first and second through channels are spatially aligned with each other in a vertical direction of the housing, and wherein each of said first and second lead contacts has a solder foot, and the solder foot of the first lead contact is spatially aligned with that of the second lead contact in a lateral direction of the housing.

4. The connector in accordance with claim 1, wherein each of said first and second outer conductors includes a knurled area at a rearmost section thereof retained to the through channel of the housing.

5. The connector in accordance with claim 1, wherein the back cover comprises a guideframe, and the rear wall of the housing defines a guideway along an outer peripheral edge thereof for receiving the guideframe of the back cover.

6. The connector in accordance with claim 1, wherein one of the ribs defines a pair of pits for receiving the inner conductors of the first and the second coaxial contacts.

7. The connector in accordance with claim 6, wherein the inner conductors are solder jointed to the lead contacts of the lead frame assembly and said pits in the ribs are slightly distanced from the solder jointed inner conductors and lead contacts to provide relief thereto.

8. An electrical connector comprising:

a conductive housing defining upper and lower through channels respectively extending along a front-to-back direction while aligned with each other in a vertical direction;

upper and lower coaxial contacts respectively received within the corresponding upper and lower through channels;

said housing defining a rear wall with a middle part thereon to separate inner and outer passageways thereof, said inner passageway and said outer passageway communicating with each other around the upper through channel; and a lead frame assembly attached to the rear wall, said lead frame assembly including lower and upper lead contacts respectively connected to the corresponding lower and upper coaxial contacts, the lower lead contact and the upper lead contact extending along the corresponding outer and inner passageways with horizontal contact feet at bottom portions thereof; wherein a back cover is attached to a rear face of the housing, covering the lead frame assembly and the inner and outer passageways.

9. The connector in accordance with claim 8, wherein the lower lead contact and the upper lead contact define end pieces connecting to the corresponding lower coaxial contact and the upper coaxial contact, and a first insulative portion connected therebetween and positioned in the outer passageway.

10. The connector in accordance with claim 9, said lead frame assembly further includes a second insulative portion holding the upper lead contact in the inner passageway.

11. The connector in accordance with claim 10, wherein said first insulative portion and said second insulative portion are connected by a support portion which extends through the middle part.

* * * * *